US006978576B2

(12) United States Patent
Shirk

(10) Patent No.: US 6,978,576 B2
(45) Date of Patent: Dec. 27, 2005

(54) GATE ASSEMBLY

(76) Inventor: R. Kevin Shirk, 541 N. Main St., Suite 104-362, Corona, CA (US) 91720

( * ) Notice: Subject to any disclaimer, the term of this patent is extended or adjusted under 35 U.S.C. 154(b) by 0 days.

(21) Appl. No.: 10/690,926

(22) Filed: Oct. 22, 2003

(65) Prior Publication Data

US 2005/0086866 A1 Apr. 28, 2005

(51) Int. Cl.[7] ..... E06B 3/68; E06B 3/32; B65F 1/00

(52) U.S. Cl. ..... 49/57; 49/463; 220/908

(58) Field of Search ..... 49/50, 55, 57, 49/463, 465, 394, 371; 16/DIG. 13, 234, 16/254, 262, 270, 272, 267, 385; 242/32, 242/35, 106, 42, 145, 150, 148, 179, 177, 242/178, 162–165; 256/1, 24, 26, 73, 25; 220/485, 908; 119/474, 513

(56) References Cited

U.S. PATENT DOCUMENTS 1,655,730 A * 1/1928 Lieberman ..... 292/33
4,178,024 A * 12/1979 Wagner ..... 292/148
4,702,036 A * 10/1987 Johnson ..... 49/55
4,722,514 A * 2/1988 Pettit ..... 256/50
4,790,578 A * 12/1988 Barrera ..... 292/148
4,930,753 A * 6/1990 Alvyn ..... 256/26
4,997,219 A * 3/1991 Carter ..... 292/148
5,494,261 A * 2/1996 Gandara ..... 256/24
5,609,327 A * 3/1997 Amidon ..... 256/24
6,739,093 B1 * 5/2004 Holbert ..... 49/394
6,802,158 B1 * 10/2004 Greene ..... 52/79.5

* cited by examiner

*Primary Examiner*—Hugh B. Thompson, II
(74) *Attorney, Agent, or Firm*—Steins & Associates, P.C.

(57) ABSTRACT

An Improved Gate Assembly is disclosed. The preferred gate assembly is constructed primarily from plastic or other resilient material that resists denting, bending, chipping, cracking, and graffiti painting. The gate assembly includes a novel mounting and hinge system from which the gates hang and swing, and which permits the pivot points to flex in order to prevent damage to the gate members themselves. The preferred gate system includes a cane bolt assembly that remains retracted while the gates are being moved, and also flexes and/or bends if the gates are struck by a vehicle. The gates include shock-absorbing bumper assemblies to prevent damage to them and may include display sections for displaying pertinent warnings or other information.

16 Claims, 6 Drawing Sheets

GATE ASSEMBLY

BACKGROUND OF THE INVENTION

1. Field of the Invention

This invention relates generally to gate and door systems and, more specifically, to an Improved Gate Assembly.

2. Description of Related Art

Trash enclosures can be found at virtually every commercial building or center. Generally speaking, the enclosure is a 3-sided cinder block wall built around one or more dumpsters or other large trash receptacle(s). For safety and aesthetic purposes, builders are required to place gates across the opening in the wall. It is these gates that are the focus of the present invention.

The trash enclosure gates are generally custom-built for each trash enclosure. They are commonly made from either metal or wood and are typically fairly heavy duty, presumably to withstand the severe abuse that they sustain from garbage trucks and their drivers. Because some trucks and drivers are so careless in their handling of the gates, the typical lifespan of a gate is only a year or so before major repairs and/or replacement is necessary. Even if the gates aren't damaged by use that quickly, they do certainly become dented, rusty and the paint fades and/or peels. What is needed is a trash enclosure gate that can withstand the bumping and abuse from garbage trucks as well as providing a non-fading and non-peeling surface over the life of the gate. Such a gate might also be available in pre-established shapes and sizes in order to cut costs and aid in project management. Furthermore, the gates should be designed to have protective bumpers as well as resilient mounting systems to permit the gates, hinges, etc. to flex, rather than deform permanently.

Another problem with the prior trash gates exists with the cane bolt. The cane bolt is a bar on the front of one or both trash doors. When each door is closed the cane bolt is slid down into a hole cut in the cement pad in the appropriate location; the cane bolt then restrains the door from opening.

The problem with these prior cane bolt systems is that the operators are unable or unwilling to be careful with them. It is a common practice for the cane bolt to be lifted only long enough to release it from the hole, thereby freeing the door for movement—the careless user then throws the door open. While the door swings, the cane bolt drags along the cement or asphalt pad, thereby creating two problems: (1) an unsightly groove is cut into the pad; and (2) the cane bolt becomes bent and unworkable. What is needed is a system that prevents the cane bolt from dragging across the ground when the user fails to hold it up while the door is swinging open or closed.

A further problem with these prior cane bolt systems is that the "careless user" frequently fails to re-insert the cane bolt in the hole before leaving the site. Without the cane bolt secured, the gates can easily come open, such as during a strong wind. What is needed is a cane bolt system that gives stronger encouragement for the "careless user" to secure the cane bolt once the gates or doors have been closed.

Finally, trash enclosures are a favorite target for "taggers", or persons spraying or writing graffiti on public or private structures. Since the trash enclosures are usually hidden from view, around the back of the buildings, they are constantly being graffitied. As a result, the gates must be repainted constantly to correct the aesthetics. What would be beneficial is a trash enclosure gate system made from material that is graffiti-proof, such that any graffiti could simply be washed off; there would be no need to re-paint the gates.

SUMMARY OF THE INVENTION

In light of the aforementioned problems associated with the devices, it is an object of the present invention to provide an Improved Gate Assembly. The gate assembly should be made primarily from plastic or other resilient material that resists denting, bending, chipping, cracking, and graffiti painting. It is a further object that the gate assembly include a novel mounting and hinge system from which the gates hang and swing, and which permits the pivot points to flex in order to prevent damage to the gate members themselves. It is a still further object that the gate system include a cane bolt assembly that will remain retracted while the gates are being moved, and also flex and/or bend if the gates are struck, for example by a vehicle. Another object is that the gates include shock-absorbing bumper assemblies to prevent damage to the gates. Finally, it is an object that the gate(s) include a display section for displaying pertinent warnings or other information.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide an Improved Gate Assembly.

Figure 1:
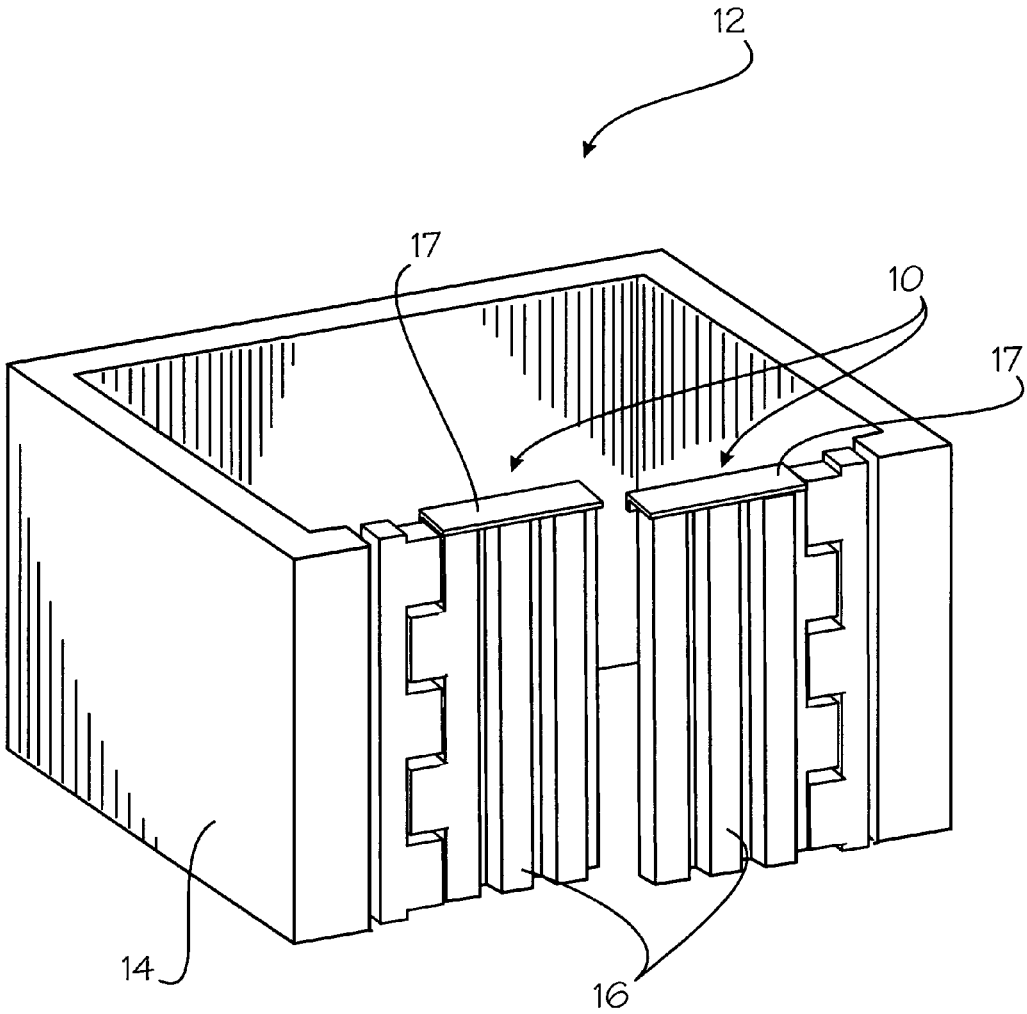
FIG. 1 is a perspective view of a preferred gate assembly of the present invention installed on a trash enclosure.

The present invention can best be understood by initial consideration of FIG. 1. FIG. 1 is a perspective view of a preferred gate assembly 10 of the present invention installed on a trash enclosure 12. Generally, the trash enclosure 12 comprises a three-sided wall 14, containing a space large enough to contain the trash containers themselves. The fourth side of the enclosure 12 is enclosed by a pair of gates 16. The gates 16 may be designed to fit only pre-established enclosure 12 and wall 14 configurations. Alternatively, the gates 16 might be comprised of a plurality of linkable panels; the user simply needs to link together the appropriate number of panels to cover the opening in the wall 14. The user may further prefer to include edge guards 17 at the top and/or bottoms of the gates 16. The preferred edge guards 17 will be from the same material as the gates 16, and be formed in either plates or "L"-shaped brackets, as shown.

Generally, the gates 16 will comprise two gates hinged at the wall 14 and meeting each other in the middle, just as with conventional gate systems. What is unique here is that the gate system 10 of the present invention includes may novel features that drastically increase the durability of the gate system 10 over these prior gates. A single gate panel 16 may be employed in lieu of a pair of gate panels 16, such as where space is a consideration.

Figure 2:
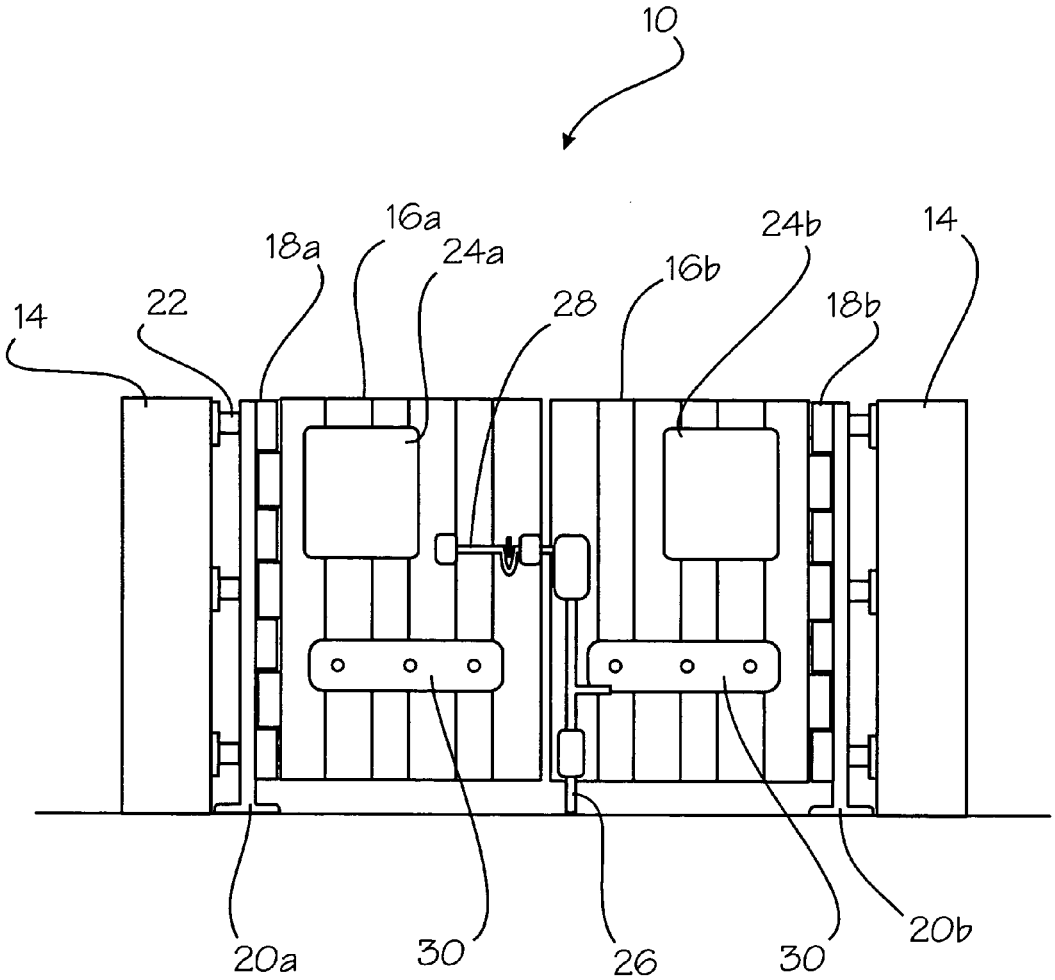
FIG. 2 is a front view of the embodiment of FIG. 1.

Now turning to FIG. 2, we might better understand the novel gate assembly 10 of the present invention. FIG. 2 is a front view of the gate assembly 10 embodiment of FIG. 1. The gate assembly 10 comprises a first gate 16*a* and a second gate 16*b*. Each gate 16 is formed from a single piece of durable material such as might be cast from a composite plastic. The plastic material will not peel, flake, chip, dent, warp or rust. Furthermore, the gates 16 may be available in a variety of colors; these colors are impregnated into the gates 16 themselves, and as such are extremely long-lasting and resistant to wear. As discussed earlier, another gate 16 embodiment may comprise two or more panels linked together. In such a case, each panel is made from a single piece of material.

The gates 16 hang from and swing on hinge assemblies 18*a* and 18*b*, respectively. The hinge assemblies 18 are molded from the same materials as the gates 16. Further detail regarding the hinge assemblies 18 is provided below in connection with FIG. 4.

At least one gate, 16*b* for example, is held in place when closed by a cane bolt 26. The cane bolt 26 may be rigid or it may allow some deflection, or even be "breakaway", in the event that a careless driver bumps or rams the gates 16. To open the gate 16*b*, the cane bolt 26 is simply slid upwardly and out of the receiving hole (not shown) formed in the ground. The cane bolt 26 may also include a means that holds the cane bolt 26 up away from the ground when the gate 16*b* is being swung open, to prevent the problem of dragging the cane bolt 26 and damaging the cement pad and/or cane bolt 26.

The gates 16 are furthermore coupled to each other by a latch bolt 28 that must be slid back to open the gates 16. To avoid the common problem of failing to secure the cane bolt 26 when the gate 16*b* is closed, the gate assembly 10 might include a means for causing the latch bolt 28 and cane bolt 26 to depend on one another to operate. Such means might prevent the latch bolt 28 from being closed until the cane bolt 26 is secured into its receiving hole (not shown). Further detail regarding the cane bolt 26 and latch bolt 28 is provided below in connection with FIGS. 7 and 8.

The hinge assembly, 18*a* for example, also includes a hinge post 20*a* that is secured to the ground as well as to the wall 14. The hinge post 20*a* is also formed from the same durable plastic material as the gates 16 and hinge assemblies 18. The hinge post 20*a* is suspended from the wall 14 by a plurality of struts 22. The struts 22 are preferably comprised from a fairly rigid, yet elastic material, such as rubber. The struts 22 will firmly restrain the hinge posts 20 from movement during normal swinging of the gates 16, but will allow the hinge posts 20 to yield if and when a truck strikes the gates 16. When the force from the truck, etc. is removed from the gate assembly 10, the struts 22 will contract to their original configuration, and the gates 16 will once again swing freely. These deformable struts 22 will, therefore, prevent permanent damage to the gate assembly 10 if the assembly is hit by a vehicle. It should be appreciated that the struts 22 shown are merely one example of a resilient, elastic mounting system for the hinge posts 20; many other designs are expected, including sliding configurations, among others. What is unique is the ability of the hinge posts 20 to temporarily deflect from vertical, and then return to their original positions. If the struts 22 are deformed beyond their elastic range, it is expected that they can be replaced very easily, again, without sacrificing the more expensive parts of the gate assembly 10, such as the gates 16.

Another feature of the gate assembly 10 of the present invention are the display surfaces 24. The display surfaces 24 are essentially flat alcove-like depressions formed into the gates 16 and possibly covered by clear plastic panels. It is believed that the display surfaces 24 will provide a convenient, orderly and protected place to post signs, warnings and the like. The actual shape, size and location of the display surfaces 24 is not critical, but only that they may be provided to give added utility to the gate assembly 10.

A still further feature of the gate assembly 10 of the present invention are the bumpers 30. The bumpers 30 are designed to give even more protection to the gate assemblies 10 against careless drivers. Should a truck be backed into the gate assembly 10, the truck will strike the bumpers 30, and not the gates 16. The bumpers 30 are designed to provide some dampening and cushioning, such as through rubber mounting components, similar to the struts 22. More detail in regard to the bumpers 30 is provided below in connection with FIG. 5.

Figure 3:
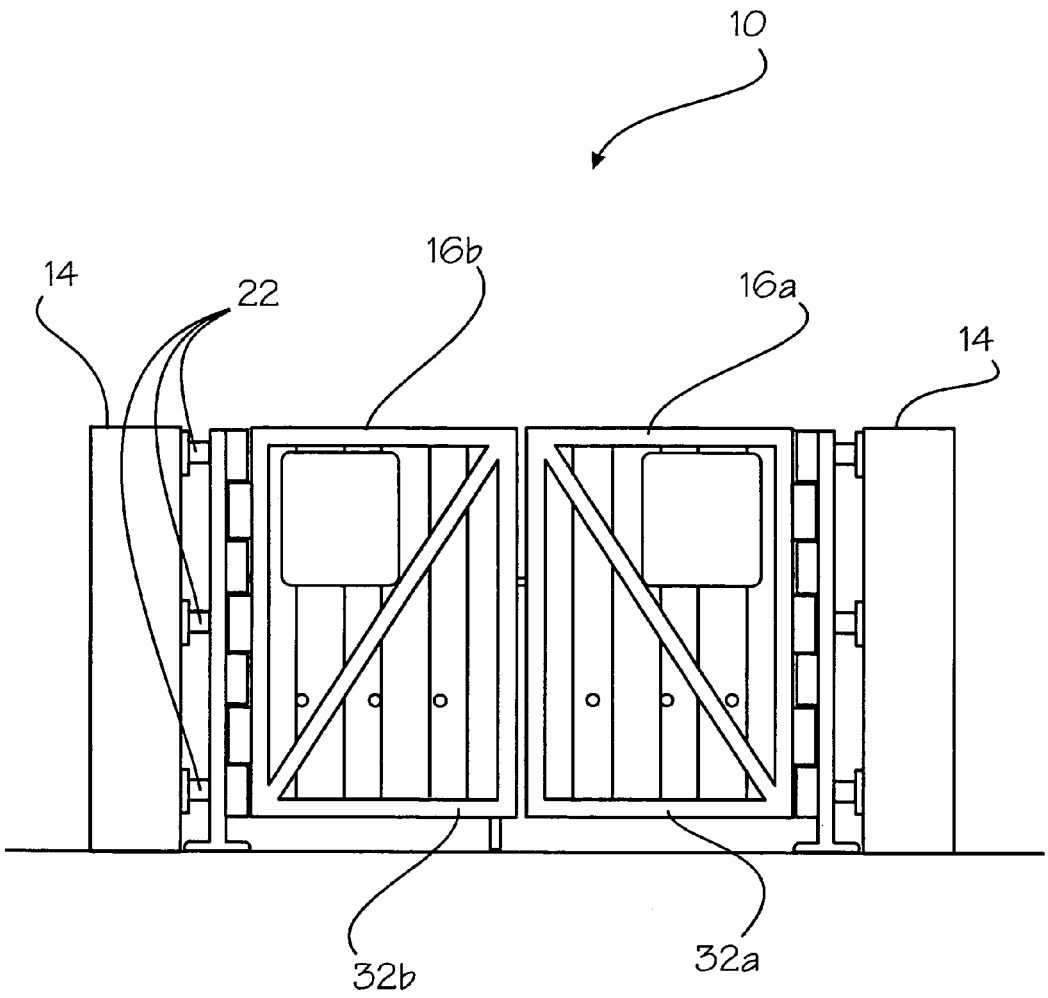
FIG. 3 is a back view of the embodiment of FIGS. 1 and 2.

Brief consideration of FIG. 3 provides additional detail of the present invention. FIG. 3 is a back view of the gate assembly 10 of FIGS. 1 and 2. From the rear, one can notice that each gate 16 includes a frame 32 to provide additional structural rigidity. Again, what is unique is that in its preferred design, the frames 32 and gates 16 comprises a unitary piece of cast or otherwise-formed material. The frames 32 may have rectangular cross sections, such as might be simulated by 2- or 3-inch rectangular tube steel. Other configurations may be available, depending upon the particular application for the gate assembly 10.

Figure 4A:
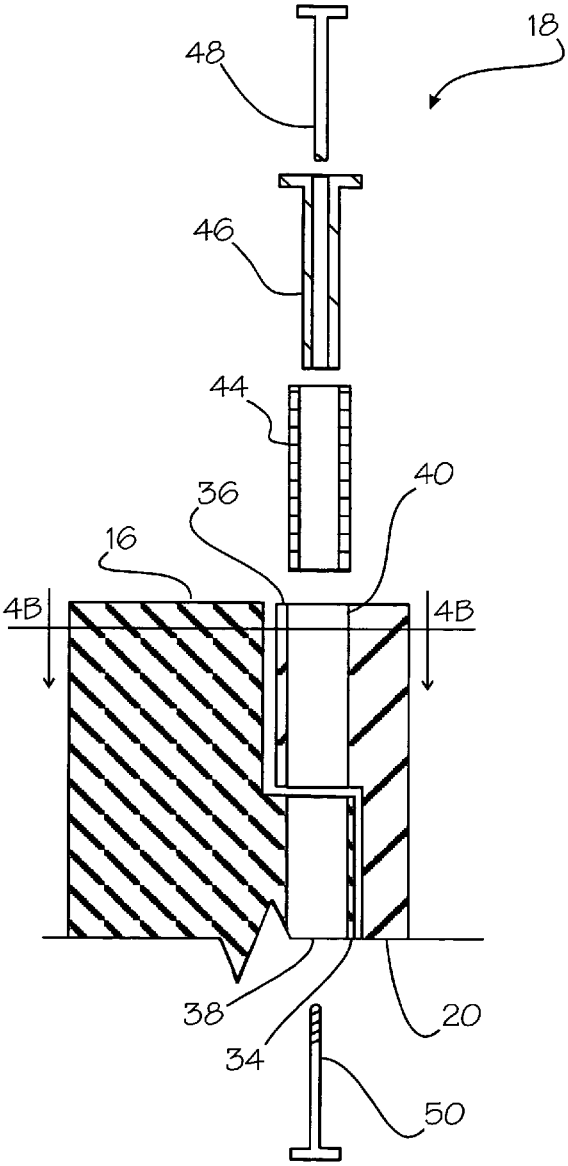
FIGS. 4A and 4B are an exploded partial cutaway side view and top view, respectively, of a preferred gate hinge system.
Figure 4B:
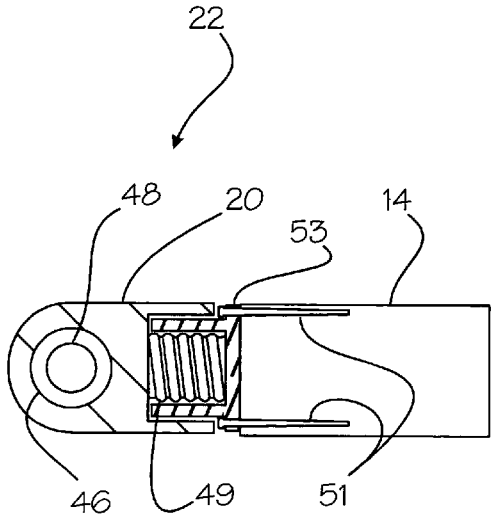

FIGS. 4A and 4B provide additional detail regarding the unique hinge assembly 18 in an exploded partial cutaway side view of same. Each gate 16 includes a plurality of gate hinge-halves 34 extending from the hinge-edge of the gate panel. These gate hinge-halves 34 cooperate with a plurality of post hinge-halves 36 formed as a unitary part of the hinge posts 20. Like a conventional door hinge, the hinge-halves 34 and 36 have a substantially tubular shape to facilitate swinging of the gate 16 relative to the hinge post 20. Furthermore, each gate hinge-half 34 is defined by a circular gate hinge bore 38 formed along the axis of rotation. Similarly, each post hinge-half 36 is defined by a circular post hinge bore 40 that is coaxial with the gate hinge bores 38.

The remaining components of the hinge assembly 18 are configured: (1) to provide maximum strength to the plastic hinge assembly 18, and (2) to provide ease of assembly and disassembly. For ease of understanding, only the top portion of the hinge assembly 18 is depicted; the bottom portion is the mirror image of the top portion, except where noted. While the depicted embodiment has a post hinge-half 36 at the top of the hinge assembly 18, other embodiments may start with a gate hinge-half 34. Furthermore, while many of the components are shown to have a particular length or other configuration, it should be understood that other lengths and configurations may be necessary for a particular installation.

Turning, now to the components of the hinge assembly 18, there is first a hinge insert 44 is inserted into the post hinge bore 40. The hinge insert 44 is made from metal or other durable material and is designed to prevent wear to the post hinge bore 40. The hinge insert 44 is configured with fins or tabs (not shown) that will engage the walls of the post hinge bore 40 to prevent the hinge insert 44 from being removed without the proper tools.

Next, a flanged insert 46 is slipped into the hinge insert 44. The flanged insert 46 is usually made from metal or other durable material and is configured to have smooth outer and inner surfaces in order to facilitate rotation between itself and the hinge insert 44. The flanged insert 46, like the hinge insert 44 has a twin inserted upwardly into the bottom of the hinge assembly 18.

Finally, a hinge rod 48 is inserted into the flanged insert 46. The hinge rod extends through substantially the entire length of the hinge assembly 18. The hinge rod 48 is made from metal, and may have a threaded aperture at its tip (not shown). The threaded aperture tip is designed to accept the hinge rod retainer 50, which is essentially a shortened duplicate of the hinge rod 48 that is designed to fit in the bottom of the hinge assembly 18 and screw into the threaded tip of the hinge rod 48. In some situations, it might be preferable to provide other means for retaining the hinge rod 48, such as simply pinning or screwing it into place, among other conventional means.

As can be seen in FIG. 4B, each strut 22 comprises a base portion 53 that is attached to the wall 14 by a conventional means, such as by driving a pair of cement nails 51 through apertures (not shown) in the base portion 53 and into the wall 14. The hinge portion 20 may be attached to the base portion 53 by a resilient member, such as the spring 49 shown. The spring 49 will permit the hinge portion 20 to actually pull away from the wall 14 in the event that the gates 16 or hinge portion 20 are struck by a vehicle.

Figure 5A:
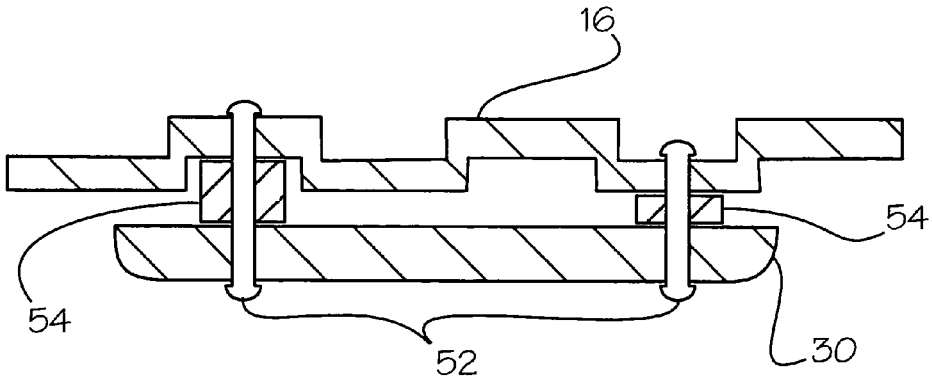
FIGS. 5A and 5B are a cutaway top view of one gate of the assembly and retaining peg of FIGS. 1–3, depicting a preferred bumper and associated members.
Figure 5B:
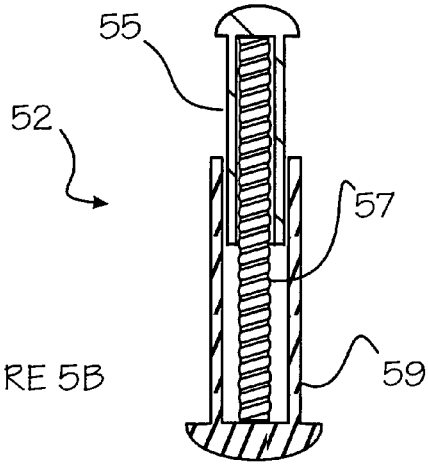

In order to understand another novel feature of the present invention, we will now turn to FIGS. 5A and 5B. FIG. 5A is a cutaway top view of one gate 16 of the gate assembly 10 of FIGS. 1–3; FIG. 5B is a cutaway top view of a preferred retaining pin 52. As a preliminary matter, one should notice the corrugated cross section of the gate 16. While this particular design is not the exclusive embodiment, it is preferred because of its inherent strength and aesthetic similarities to wood paneling. In at least one location on each of the gates 16, there may be a bumper 30 installed. The bumper 30 is probably plastic, like the rest of the gate assembly 10, or it may be metal or other durable material. The bumper 30 is attached to the gate 16 in a way to provide cushioning therebetween to prevent the gate 16 from being damaged if the bumper 30 is struck, such as by a truck. In the present embodiment, the bumper 30 is attached to the gate 16 by a plurality of retaining pegs 52. The retaining pegs 52 are durable plastic or metal and are designed to securely hold the bumper 30 in place, such as by screw-in or riveted attachment. Sandwiched between the bumper 30 and the gate 16 are grommets 54. The grommets 54 are likely to be rings made from rubber of other elastic, durable material that is threaded over the retaining pegs 52 when the bumper 30 is being attached to the gate 16.

FIG. 5B depicts a preferred retaining pin 52 design. The pin 52 may comprise an inner sleeve member 55 that slidingly engages with an outer sleeve member 59. The inner and outer sleeve members 55 and 59 are preferably attached to one another by a biasing means 57, such as a spring assembly, to hold the outer sleeve 59 in engagement with the inner sleeve 55 until the bumper 30 or gate panel 16 is struck by something, under which conditions, the inner and outer sleeves 55 and 59 will be permitted to slide apart in order to absorb the impact, rather than permit the gate 16 or hinges (not shown) to be damaged.

Figure 6:
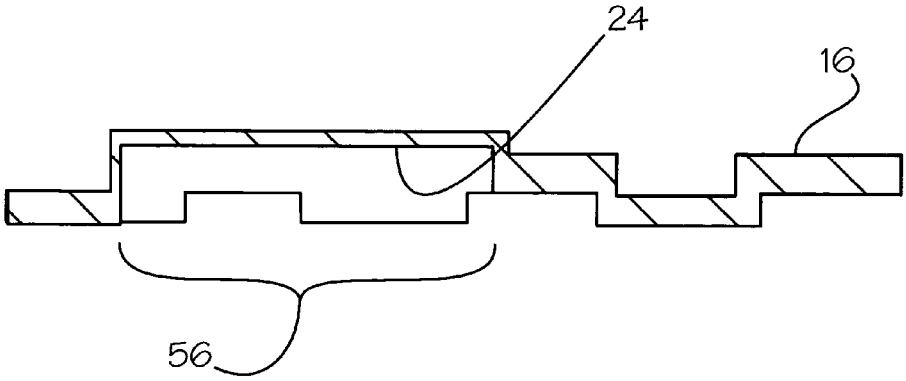
FIG. 6 is a cutaway top view of one gate of the assembly of FIGS. 1–3, depicting a preferred display alcove and surface.

FIG. 6 is a cutaway top view of one gate 16 of the gate assembly 10 of FIGS. 1–3, depicting the aforementioned display surface 24. Essentially, the display surface 24 is created by the formation of a display alcove 56, which is a depression of rectangular or other shape created within the gate panel 16. Because the gate 16 is cast or molded from a single piece of material, there is great flexibility in the shapes and locations of the display alcove 56. The display surface 24, as mentioned previously, is provided to permit an owner to post warning signs or other labels to the gates 16. A clear plastic pane (not shown) may be provided for attaching over the display alcove 56 in order to protect any labels applied to the display surface 24.

Figure 7:
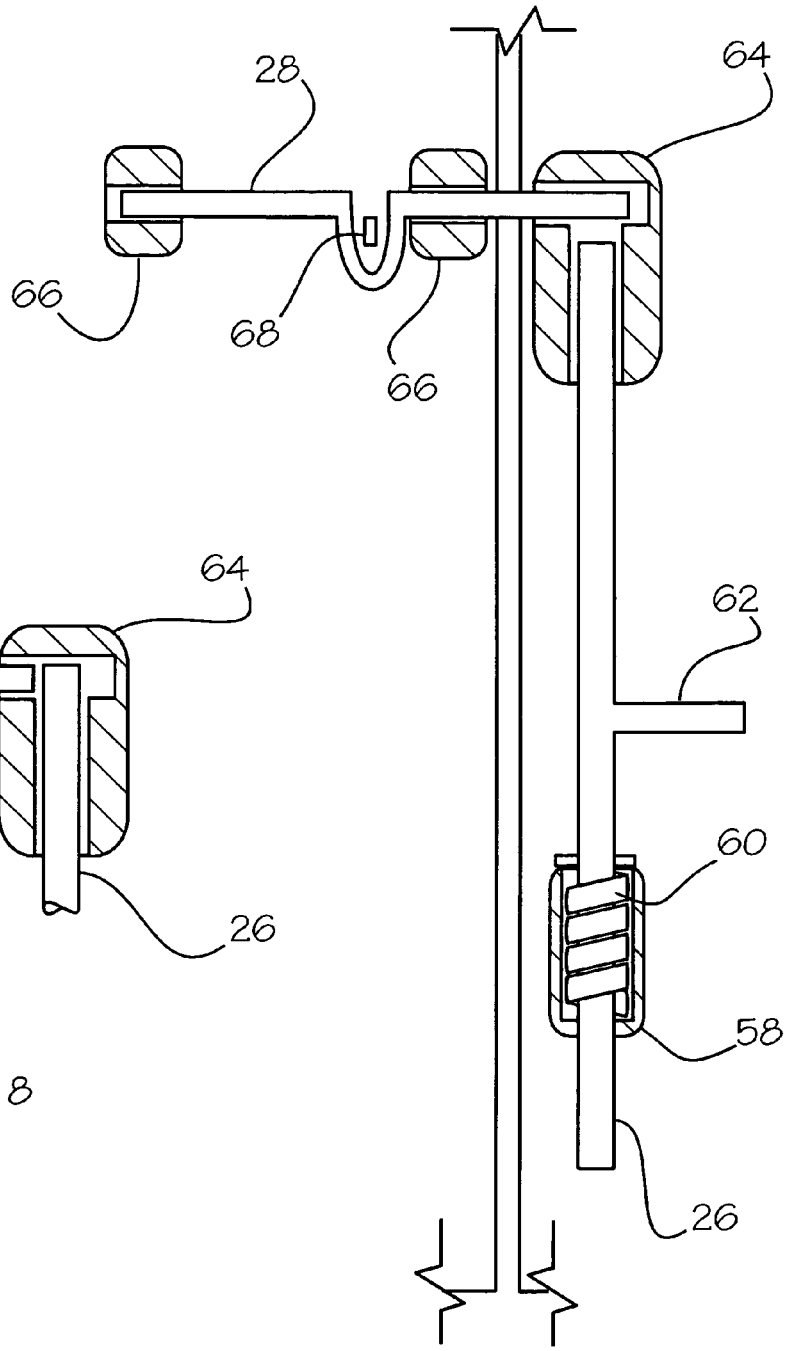
FIG. 7 is a partial cutaway front view of the embodiment of FIGS. 1–3, depicting a preferred latch bolt and cane bolt.

As discussed above in reference to the background of the present invention, a particular problem with the prior gate systems exists with the cane bolt and latch bolt operation. To remedy the problem with drivers' failing to engage the cane bolt 26, the present invention includes means for preventing the user from securing the latch bolt 28 before the cane bolt 26 is engaged to the ground. Furthermore, to prevent the dragging cane bolt 26 problem, the present assembly includes means for pulling the cane bolt 26 up and away from the ground when the cane bolt 26 is not engaged. FIG. 7 is a partial cutaway front view of the embodiment of FIGS. 1–3, depicting a preferred latch bolt 28 and cane bolt 26 design, and wherein the cane bolt 26 is in the extended or engaged position.

As can be seen, the cane bolt 26 extends upwardly through the cane bolt guide 58. The cane bolt guide 58 is ideally a cylindrical enclosure that guides the cane bolt 26 in its travel, as well as houses the biasing means 60. The biasing means 60 biases the cane bolt 26 upwardly to prevent it from dragging on the ground when disengaged. One biasing means 60 may be a conventional coil spring; other durable means for biasing the cane bolt 26 upwardly may be appropriate in some circumstances.

Continuing up the cane bolt 26, a cane bolt handle 62 is encountered. The cane bolt handle 62 provides the user with a means for lowering the cane bolt 26 to engage it with the ground. The end of the cane bolt 26 slidingly resides within the latch-cane interface means 64. The latch-cane interface means 64 is where the axis' of the latch bolt 28 and the cane bolt 26 intersect. As such, only one of the two may be fully extended into the latch-cane interface means 64 at one time. Consequently, the cane bolt 26 must be retracted from the latch-cane interface means 64 (and locked into the ground) before the latch bolt 28 can be extended and locked. Obviously, then, when the latch bolt 28 is retracted (i.e. the gates 16 are unlocked), the cane bolt 26 is free to be urged upwardly by the biasing means 60.

Figure 8:
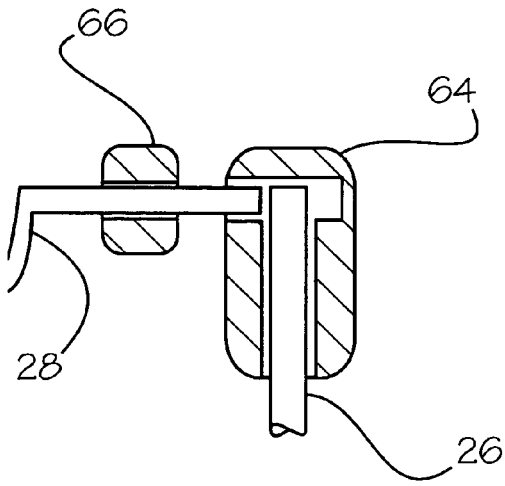
FIG. 8 is a partial cutaway front view of the latch and cane bolt of FIG. 7, depicting the cane bolt in a raised position.

The latch bolt 28 slides back and forth within a pair of latch bolt guides 66. A hasp 68, configured to accept a locking device, might extend outwardly from the gate 16. If the user desires to lock the gate 16 shut, he or she must simply extend the latch bolt 28 and then install the lock through the hasp 68. FIG. 8 depicts the latch-cane interface means 64 when the latch bolt 28 has just been retracted, thereby causing the biasing means (see FIG. 7) to push the cane bolt 26 up into the latch-cane interface means 64. The preferred cane bolt 26, latch bolt 28 and other parts described herein will be made from metal or other durable material. It is critical that the reader understand that the depicted design for the latch bolt 28 and cane bolt 26 and the interface between the two is simply one embodiment; many other designs are available. What is important is the novel interaction and dependency between the two members, not the actual engineering design of this interaction.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A gate assembly for trash enclosures, each of said enclosures defined by walls and the ground, comprising:

a pair of hinge posts, each said hinge post comprising a strut side for attaching to at least one elastic strut member, each said elastic strut member comprising a base portion attachable said walls, and a resilient member interconnecting said base portion and said strut side; and a pair of gates, each said gate made from a single piece of plastic material and attached to one said hinge post by hinge means for permitting angular movement between each said gate and each said hinge post.

2. The assembly of claim 1, wherein at least one of said gates further comprises bump protecting means for protecting said gate from being bumped by vehicles.

3. The gate assembly of claim 2, wherein:

said assembly further comprises hinges between said gates and said hinge posts;

each said gate comprises a center edge and a hinge edge, said hinges defined by a plurality of gate hinge-halves, each said gate hinge-half defined by a gate hinge bore;

each said hinge post further comprises a hinge side defined by a plurality of post hinge-halves, each said post hinge-half defined by a post hinge bore; and said hinge means comprises a hinge rod inserted trough a bore line defined by an interlocking series of coaxially-aligned gate hinge-halves and bores and post hinge-halves and bores.

4. The gate assembly of claim 3, wherein said hinge means further comprises at least one hinge insert, each said insert being inserted into said bore line and further defined by a hinge insert bore.

5. The gate assembly of claim 4, wherein each said hinge means further comprises at least one flanged insert defined by a bore portion and a flanged portion, each said at least one flanged insert being inserted into one said hinge insert bore.

6. The gate assembly of claim 5, wherein said hinge means is further defined by a hinge rod retainer for retaining said hinge rod within said bore line.

7. The gate assembly of claim 6, wherein:

each said hinge post and said post hinge-halves extending therefrom are made from a single piece of plastic-like material; and each said gate and said gate hinge-halves extending therefrom are made from a single piece of plastic-like material.

8. The gate assembly of claim 7, further comprising at least one cane bolt assembly for attaching at least one said gate to said ground, said cane bolt assembly defining at least a locked condition.

9. The gate assembly of claim 8, wherein said cane bolt assembly further comprises cane bolt and biasing means for biasing said cane bolt away from the ground.

10. The gate assembly of claim 8, further comprising:

latch bolt means for attaching each said gate to the other said gate; and interface means for making activation of said latch bolt means dependent upon said condition of said at least one cane bolt assembly.

11. A gate assembly, comprising:

a pair of gates, each said gate comprising a single piece of flexible, resilient material;

a pair of hinge posts, each said hinge post comprising a single piece of flexible, resilient material;

hinge means for attaching one said gate to one said hinge post; and a plurality of elastic strut members interconnecting said hinge posts to external walls each said elastic strut member comprising a base portion fixedly attachable to the walls and a resilient member interconnecting said base portion and said hinge post.

12. The gate assembly of claim 11, wherein each said gate further comprises an integral frame formed in said flexible, resilient material.

13. The gate assembly of claim 12, wherein at least one said gate is further defined by a display alcove formed therein for display of certain signs.

14. The gate assembly of claim 13, wherein at least one said gate is further defined by a bump protection means for protecting said gate from damage due to being bumped by a vehicle.

15. The gate assembly of claim 14, wherein each said gate comprises a plurality of staggered panels.

16. The gate assembly of claim 15, wherein said hinge means comprises a hinge rod inserted into at least one flanged insert, said flanged insert inserted into at least one hinge insert, and said hinge insert inserted into a bore line formed between said hinge post and said gate.

* * * * *